US007748646B2

(12) United States Patent
Clark

(10) Patent No.: US 7,748,646 B2
(45) Date of Patent: Jul. 6, 2010

(54) GEAR DRIVEN SPRINKLER WITH TOP TURBINE

(75) Inventor: Michael L. Clark, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 45 days.

(21) Appl. No.: 11/762,678

(22) Filed: Jun. 13, 2007

(65) Prior Publication Data

US 2008/0308650 A1 Dec. 18, 2008

(51) Int. Cl.
*B05B 15/10* (2006.01)

(52) U.S. Cl. ..... 239/204; 239/242; 239/240; 239/380; 239/214.21; 239/206; 239/201

(58) Field of Classification Search ..... 239/204, 239/380, 381, 201, 200, 231, 97, 237, 214.19, 239/238, 248, 203, 206, 214.13, 242
See application file for complete search history.

(56) References Cited

U.S. PATENT DOCUMENTS 3,107,056 A * 10/1963 Hunter ..... 239/206
3,713,584 A * 1/1973 Hunter ..... 239/206
3,724,757 A * 4/1973 Hunter ..... 239/205
3,854,664 A * 12/1974 Hunter ..... 239/206
3,921,912 A * 11/1975 Hayes ..... 239/242
3,934,820 A * 1/1976 Phaup ..... 239/205
4,131,234 A * 12/1978 Pescetto ..... 239/457
4,201,344 A * 5/1980 Lichte ..... 239/242
4,708,291 A * 11/1987 Grundy ..... 239/242
4,842,201 A 6/1989 Hunter ..... 239/396
4,867,379 A 9/1989 Hunter ..... 239/240
4,898,332 A 2/1990 Hunter et al. ..... 239/240
4,932,590 A * 6/1990 Hunter ..... 239/222.17
4,967,961 A 11/1990 Hunter ..... 239/240
4,971,250 A * 11/1990 Hunter ..... 239/222.17
5,383,600 A * 1/1995 Verbera et al. ..... 239/205
5,641,122 A * 6/1997 Alkalai et al. ..... 239/206
5,718,381 A * 2/1998 Katzer et al. ..... 239/222.11
6,651,904 B2 * 11/2003 Roman ..... 239/204
6,942,164 B2 * 9/2005 Walker ..... 239/204
7,028,920 B2 * 4/2006 Hekman et al. ..... 239/240
7,090,146 B1 8/2006 Ericksen et al. ..... 239/200
7,159,795 B2 * 1/2007 Sesser et al. ..... 239/203
2005/0173557 A1 * 8/2005 Kah, III ..... 239/225.1

FOREIGN PATENT DOCUMENTS

WO WO 2004071170 A2 * 8/2004

* cited by examiner

*Primary Examiner*—Len Tran
*Assistant Examiner*—Trevor E McGraw
(74) *Attorney, Agent, or Firm*—Michael H. Jester

(57) ABSTRACT

A sprinkler comprises a nozzle, a turbine and a gear train reduction. The gear train reduction has an output stage that is coupled to the nozzle. The turbine is located between the nozzle and the gear train reduction and is coupled to an input stage of the gear train reduction.

21 Claims, 6 Drawing Sheets

GEAR DRIVEN SPRINKLER WITH TOP TURBINE

FIELD OF THE INVENTION

The present invention relates to sprinklers used to irrigate turf and landscaping, and more particularly, to irrigation sprinklers that incorporate a turbine.

BACKGROUND OF THE INVENTION

Many geographic locations have insufficient rainfall or dry spells that require turf and landscaping to be watered to maintain the proper health of the vegetation. Turf and landscaping are often watered utilizing an automatic irrigation system that includes a programmable controller that turns a plurality of valves ON and OFF to supply water through underground PVC pipes connected to sprinklers. Golf courses, playing fields and other large areas typically require rotor-type sprinklers that eject a long stream of water via a nozzle that oscillates through an adjustable arc. Smaller areas are often watered with rotary stream sprinklers and spray heads. In some cases drip nozzles are employed in residential and commercial irrigation systems for watering trees and shrubs, for example.

Rotor-type sprinklers and rotary stream sprinklers often incorporate a turbine and gear train reduction for slowly rotating the nozzle or nozzle head. The turbine is located at the bottom of the sprinkler, below the gear box that holds the gear train reduction, and above the stator where one is employed. While this configuration has proven successful, it has certain limitations that the irrigation industry has so far overlooked and/or failed to adequately address.

SUMMARY OF THE INVENTION

According to the present invention, a sprinkler comprises a nozzle, a turbine and a gear train reduction. The gear train reduction has an output stage that is coupled to the nozzle. The turbine is located between the nozzle and the gear train reduction and is coupled to an input stage of the gear train reduction.

DETAILED DESCRIPTION

The entire disclosures of U.S. Pat. Nos. 4,842,201; 4,867,379; 4,898,332; 4,932,590; 4,967,961; and 4,971,250, all granted to Edwin J. Hunter and assigned to Hunter Industries, Inc., are hereby incorporated by references.

Figure 1:
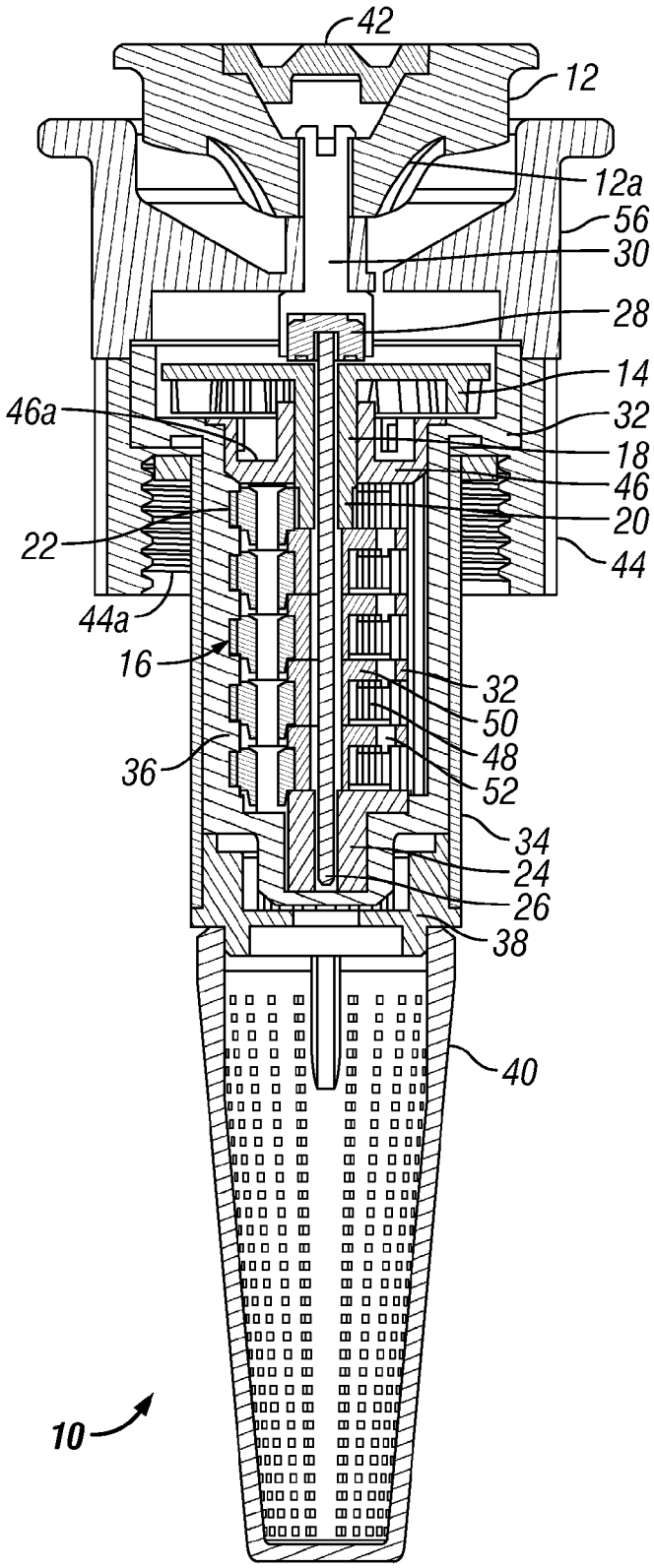
FIG. 1 is a vertical sectional view of a sprinkler in accordance with an embodiment of the present invention. Part of the gearbox is fragmented in this view.
Figure 2:
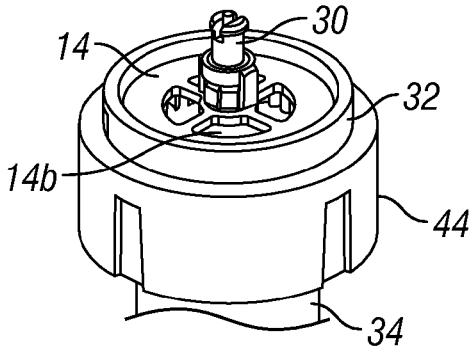
FIG. 2 is an enlarged fragmentary isometric view of a portion of the sprinkler of FIG. 1.
Figure 5:
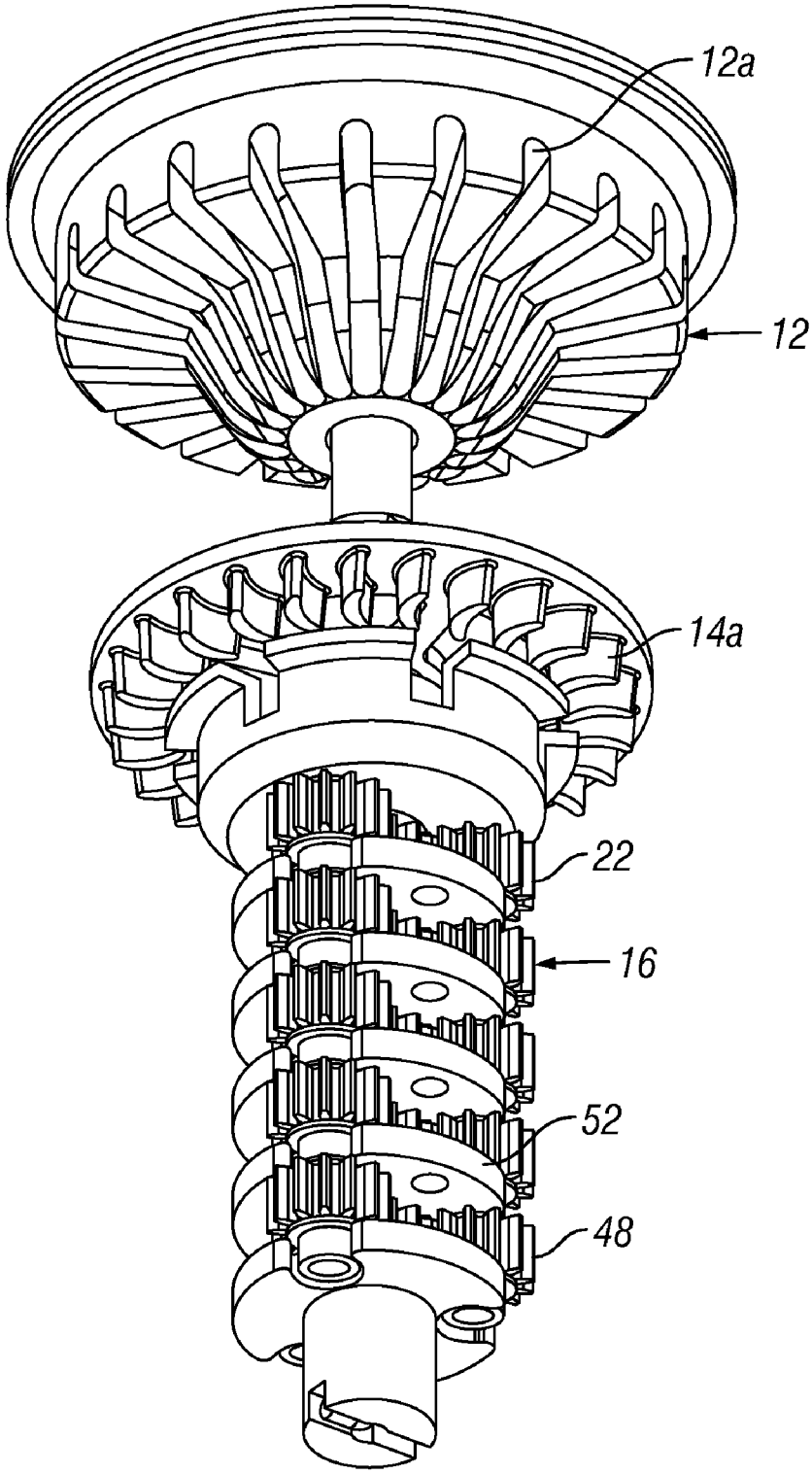
FIG. 5 is an enlarged isometric underside view of the gear train reduction, turbine and nozzle of the sprinkler of FIG. 1.
Figure 6:
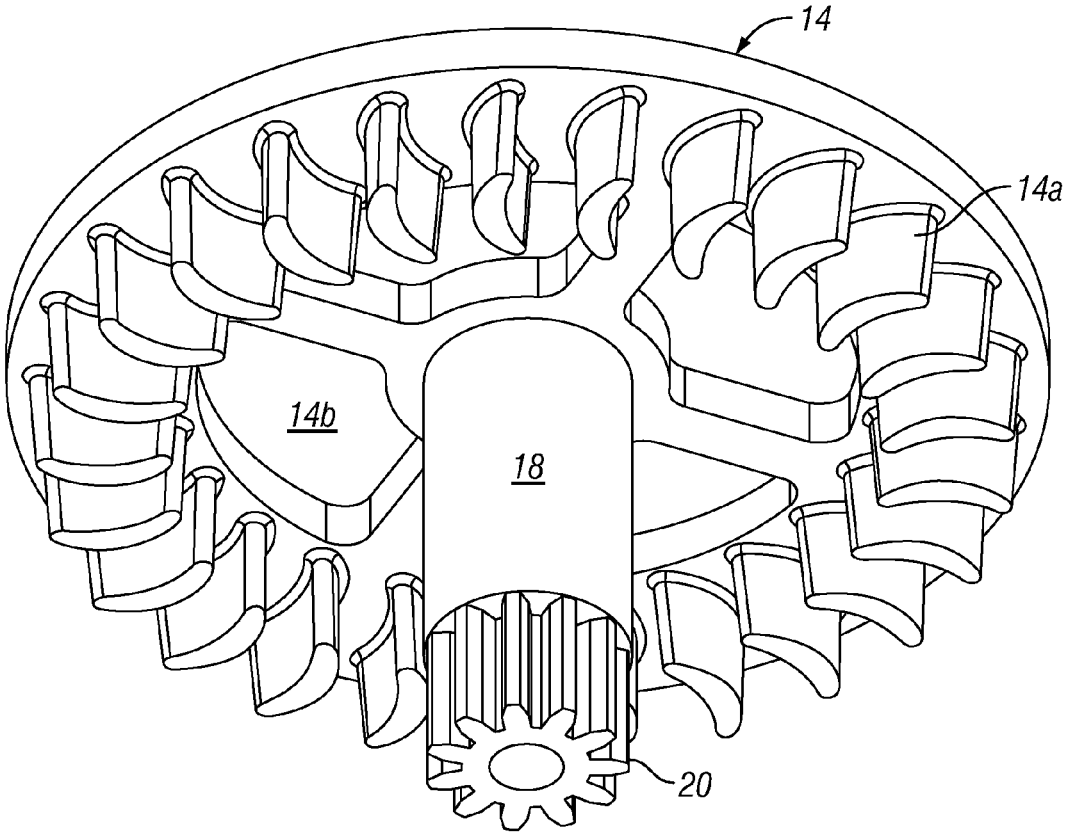
FIG. 6 is a still further enlarged isometric view of the turbine of the sprinkler of FIG. 1.
Figure 7:
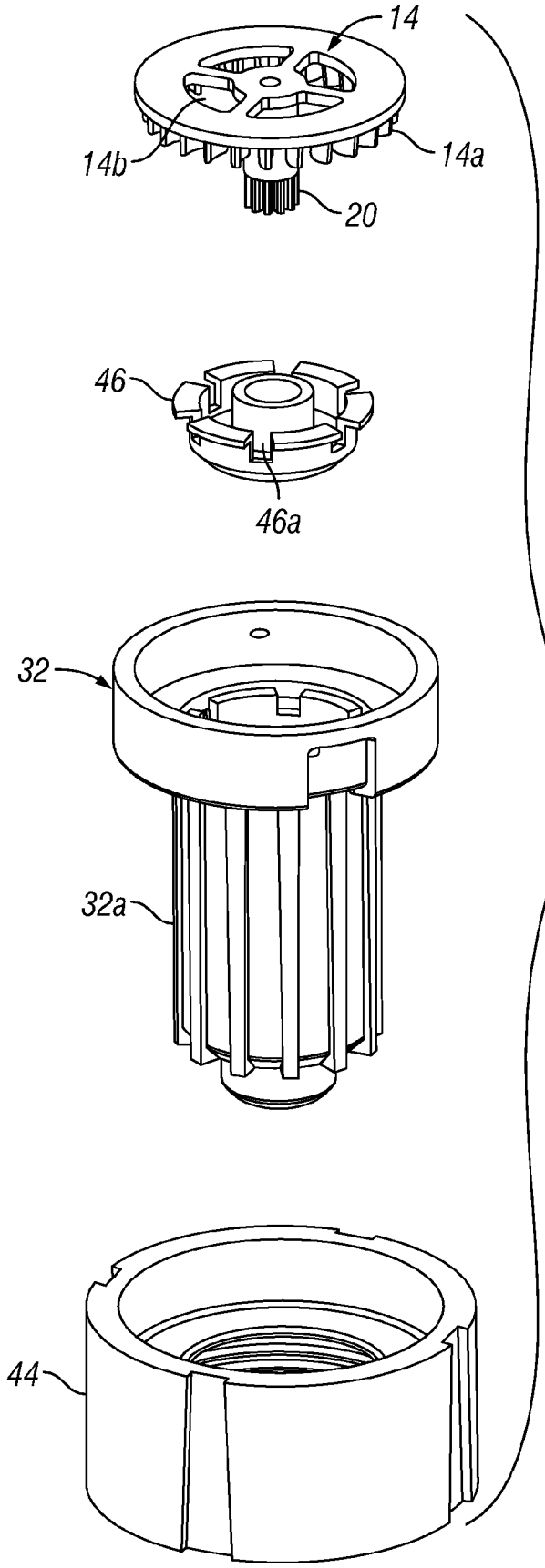
FIG. 7 is an exploded isometric view of the nozzle base, gear box, by-pass flow member and turbine of the sprinkler of FIG. 1.

Referring to FIG. 1, a sprinkler 10 comprises a nozzle 12, a turbine 14, and a planetary gear train reduction 16. The turbine 14 has curved blades 14*a* (FIG. 5) and is integrally formed with a hollow central shaft 18 (FIG. 6) having a pinion gear 20 that drives an upper input stage 22 (FIG. 1) of the gear train reduction 16. Water can flow through apertures 14*b* (FIG. 7) in the turbine 14. The gear train reduction 16 (FIG. 1) has a lower output stage 24 that is rigidly coupled to the lower end of a drive shaft 26. The drive shaft 26 extends through the axial center of the gear train reduction 16 and loosely through turbine 14. The upper end of the drive shaft 26 is coupled to the nozzle 12 via clutch dog 28 and clutch cup 30. The turbine 14 is advantageously located at the top of the sprinkler 10 between the nozzle 12 and the gear train reduction 16 and is coupled to the input stage 22 of the gear train reduction 16. The gear train reduction 16 has the configuration of a planetary gear drive, although a staggered gear drive, and other forms of gear train reduction could also be used.

The nozzle 12 (FIG. 1) is a rotary distributor head with an inverted frusto-conical configuration. The nozzle 12 has a plurality of radially extending recesses 12*a* (FIG. 5) formed on the underside thereof and is capable of simultaneously ejecting a plurality of streams of water. The gear drive train reduction 16 is enclosed in a gear box 32 (FIG. 7) having a ring gear formed on an interior surface of a lower segment 32*a* thereof. A cylindrical housing 34 (FIG. 1) surrounds and supports the gear box 32 and defines a primary flow path 36 leading to the turbine 14. A screen retainer 38 snap fits into the lower end of the housing 34 and removably receives a screen 40 that filters dirt and other debris. A cap 42 snap fits into the top side of the nozzle 12.

Figure 3:
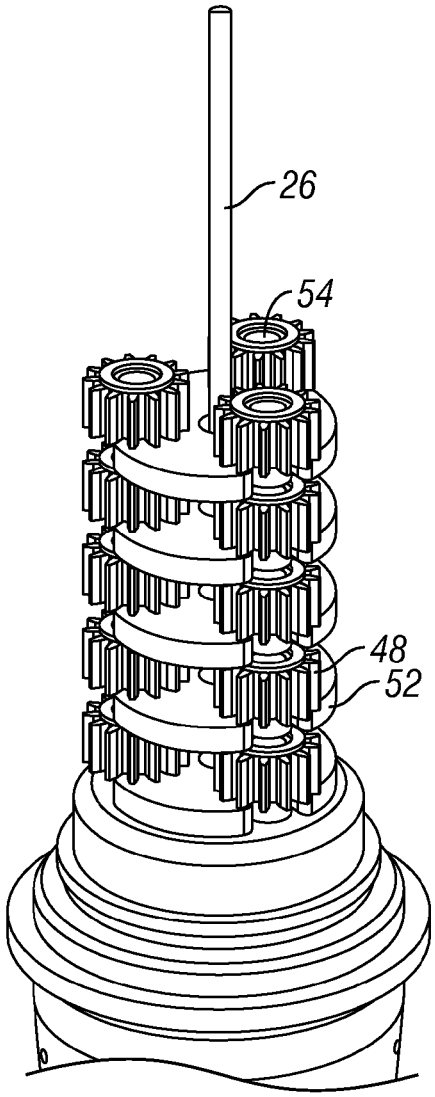
FIG. 3 is a fragmentary isometric view illustrating details of the planetary gear drive of the sprinkler of FIG. 1.
Figure 8:
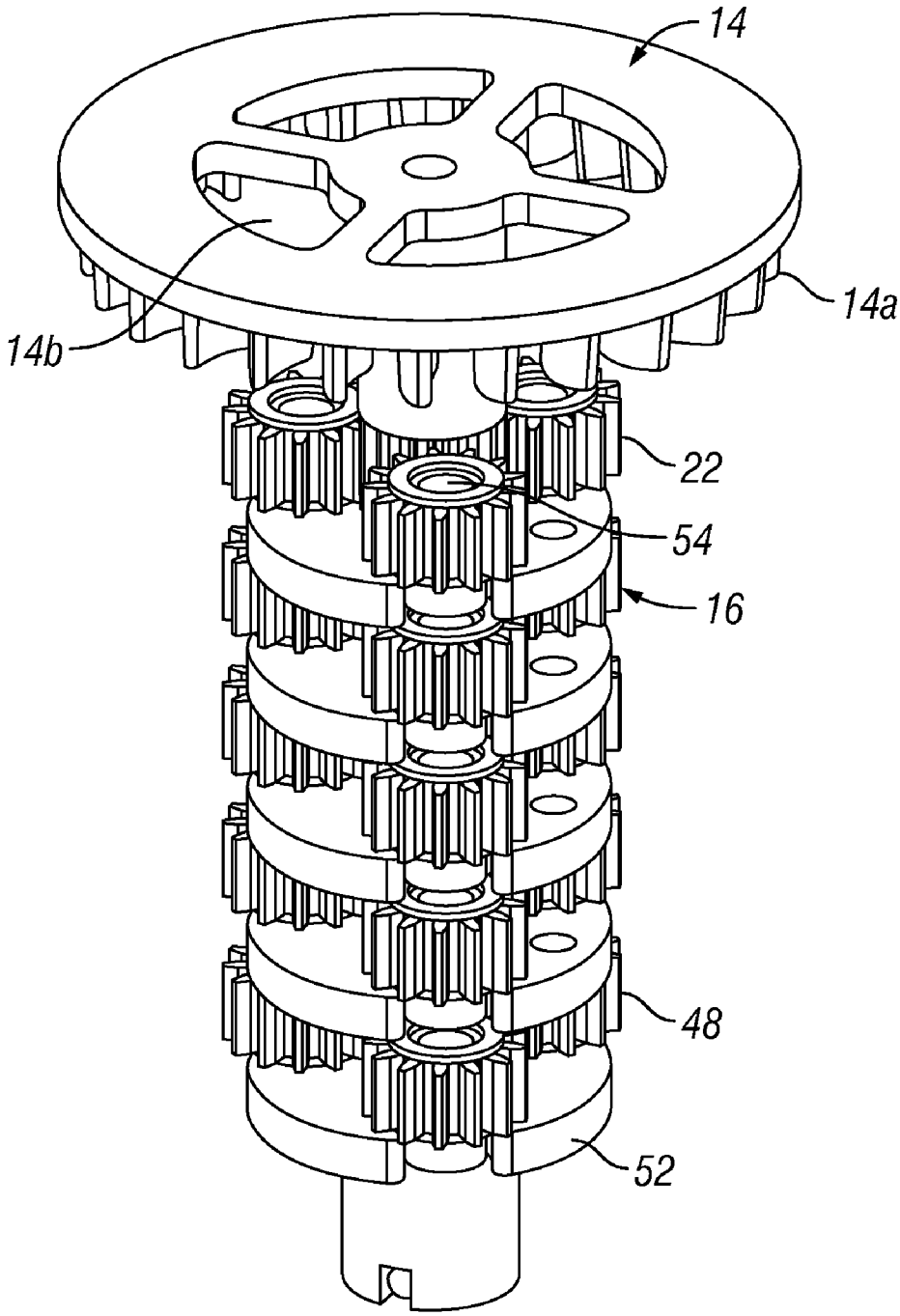
FIG. 8 is a view similar to FIG. 5 taken from the upper side.

A cylindrical nozzle base 44 (FIG. 1) surrounds the turbine 14 and the gear train reduction 16. The nozzle base 44 has a female threaded segment 44*a* for screwing over the male threaded upper segment of a fixed riser (not illustrated). The nozzle base 44 could instead have a male threaded segment for screwing over a female threaded upper segment of a fixed riser. The sprinkler 10 has a secondary flow path that includes small radial channels 46*a* (FIG. 7) in a by-pass flow member or disk 46. The size and/or arrangement of the channels 46*a* can be changed to adjust the pattern of the streams and/or the flow rate. The gear train reduction 16 includes planet gears 48 and sun gears 50 (FIG. 1). Each central sun gear 50 (FIG. 1) is integrally formed to a circular carrier 52 (FIGS. 3, 5 and 8) with fixed posts 54 that rotatably support the associated planet gears 48. A cylindrical nozzle plate 56 (FIG. 1) mates with the upper end of the nozzle base 44 and surrounds the nozzle 12. The planet gears 48 engage the ring gear formed on the interior of the lower segment 32*a* (FIG. 7) of the gear box 32. The planetary gear train reduction 16 thus reduces the RPM of the turbine 14, which is typically several hundred, down to less than one.

Figure 4:
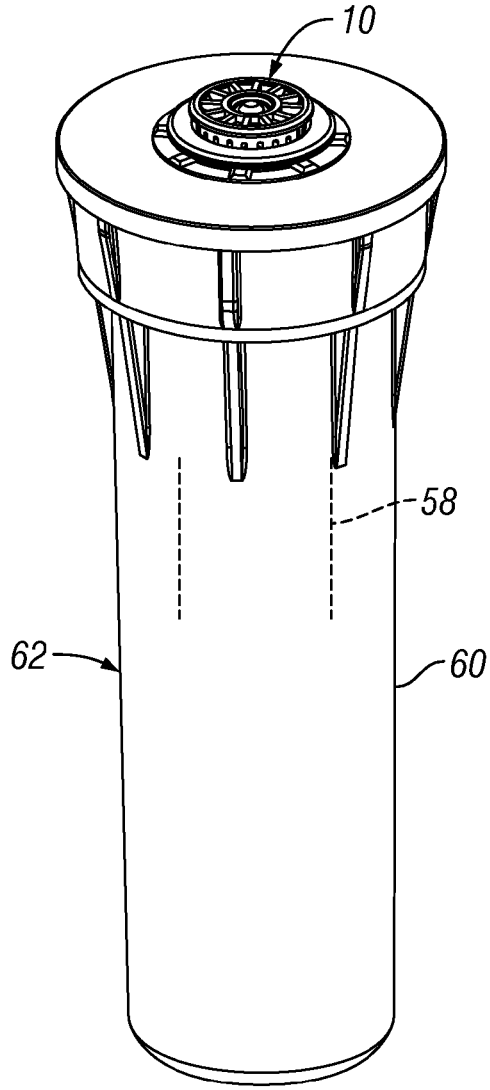
FIG. 4 illustrates an alternate embodiment in which the sprinkler of FIG. 1 is supported in a pop-up riser that telescopes from an outer case.

Referring to FIG. 4, the sprinkler 10 may be supported inside a riser 58 that telescopes within a fixed outer cylindrical case 60. This provides a self-contained pop-up sprinkler 62. The sprinkler 10 is modular in the sense that it can be manufactured with varying water distribution patterns and/or flow rates and can be conveniently screwed into the top of a fixed riser instead of a spray head.

Locating the turbine 14 above the gear train reduction 16 eliminates the pressure difference that otherwise tends to cause dirt and other debris to enter the gear box 32. The top placement of the turbine 14 reduces adverse effects of water and air surges that can damage a turbine located at the lower end of a sprinkler. Locating the turbine 14 at the top of the sprinkler 10 allows the turbine to have a larger diameter which produces a larger drive force for the nozzle 12. The additional water flow needed for large radius or arc of coverage does not have to flow around the turbine 14, thereby providing increased torque.

While I have described and illustrated an embodiment of my gear driven sprinkler with a top turbine in detail, it should be apparent to those skilled in the art that my invention can be modified in arrangement and detail. For example, there may be a stator or bias opening above the turbine 14 for flow requirements from a larger nozzle, increased arc or increased radius. The sprinkler 10 may have a fixed arc or an adjustable arc. Other components may be included to control the radius. The sprinkler 10 may have an alternate nozzle that only ejects a single stream of water. Therefore, the protection afforded my invention should only be limited in accordance with the following claims.

I claim:

1. A sprinkler, comprising:

a gear drive mounted inside a gear box and including an upper input stage and a lower output stage;

an inverted frusto-conical rotary distributor head coupled to the output stage of the gear drive, the rotary distributor head having a plurality of circumferentially spaced radially extending recesses;

a turbine located between the rotary distributor head and the gear drive and coupled to the input stage of the gear drive;

a housing that defines a flow path between the gear box and the housing, the flow path leading to the turbine;

a nozzle base that supports the gear box and includes a threaded segment that can be screwed to an upper threaded segment of a riser; and a nozzle plate supported by the nozzle base adjacent the rotary distributor head and configured to direct water into the recesses so that the recesses can simultaneously eject a plurality of outwardly directed streams of water.

2. The sprinkler of claim 1 and further comprising a drive shaft coupling the gear drive and the rotary distributor head.

3. The sprinkler of claim 2 and further comprising a clutch coupling the drive shaft to the rotary distributor head.

4. The sprinkler of claim 1 wherein the nozzle plate is mounted to the nozzle base.

5. The sprinkler of claim 1 wherein the turbine has curved blades.

6. The sprinkler of claim 1 and further comprising a by-pass flow member above the gear drive.

7. The sprinkler of claim 1 and further comprising a screen connected to the gear box.

8. The sprinkler of claim 1 wherein the recesses in the rotary distributor head have a curved configuration.

9. The sprinkler of claim 1 wherein the gear drive is a planetary gear drive.

10. A sprinkler, comprising:

a gear drive;

a rotary distributor head coupled for rotation by the gear drive, the rotary distributor head having a plurality of radially extending recesses;

a turbine coupled to the gear drive and located between the rotary distributor head and the gear drive;

a nozzle adjacent the rotary distributor head with an orifice located and configured to direct water into the recesses so that the recesses can eject a plurality of outwardly directed streams of water; and a nozzle base that supports the gear drive and includes a threaded segment for screwing to an upper threaded segment of a riser.

11. The sprinkler of claim 10 and further comprising a drive shaft coupling the gear drive and the rotary distributor head.

12. The sprinkler of claim 11 and further comprising a clutch coupling the drive shaft to the rotary distributor head.

13. The sprinkler of claim 10 wherein the recesses in the rotary distributor head are curved.

14. The sprinkler of claim 10 wherein the nozzle base has an axial length that terminates above a lower end of the gear drive so that the gear drive can be inserted into the top end of the riser and the base screwed to the upper threaded segment of the riser instead of a spray head.

15. The sprinkler of claim 10 wherein the gear drive is mounted inside a gear box.

16. The sprinkler of claim 15 and further comprising a screen connected to the gear box.

17. The sprinkler of claim 10 and further comprising a by-pass flow member above the gear drive.

18. The sprinkler of claim 10 wherein the rotary distributor head has a frusto-conical configuration.

19. The sprinkler of claim 10 wherein the gear drive is a planetary gear drive.

20. The sprinkler of claim 10 wherein the nozzle base and the nozzle are configured to produce a fixed arc of coverage.

21. The sprinkler of claim 10 wherein the nozzle base and the nozzle are configured to produce an adjustable arc of coverage.

* * * * *